US007052240B2

(12) United States Patent
Race et al.

(10) Patent No.: US 7,052,240 B2
(45) Date of Patent: May 30, 2006

(54) ROTATING SEAL ARRANGEMENT FOR TURBINE BUCKET COOLING CIRCUITS

(75) Inventors: Nathan Race, Clemson, SC (US); Kevin Worley, Easley, SC (US); Raymond Lecuyer, Taylors, SC (US)

(73) Assignee: General Electric Company, Schenectady, NY (US)

( * ) Notice: Subject to any disclaimer, the term of this patent is extended or adjusted under 35 U.S.C. 154(b) by 99 days.

(21) Appl. No.: 10/824,487

(22) Filed: Apr. 15, 2004

(65) Prior Publication Data

US 2005/0232772 A1 Oct. 20, 2005

(51) Int. Cl.
*F01D 5/06* (2006.01)

(52) U.S. Cl. ..... 416/198 A; 416/248

(58) Field of Classification Search ..... 415/199.5; 416/198 A, 204 A, 201 R, 219 R, 248
See application file for complete search history.

(56) References Cited

U.S. PATENT DOCUMENTS

| | | | | |
|---|---|---|---|---|
| 4,480,958 | A | 11/1984 | Schlechtweg | |
| 4,484,858 | A * | 11/1984 | Kurosawa et al. | 416/95 |
| 4,500,098 | A | 2/1985 | Wilcox et al. | |
| 5,622,475 | A | 4/1997 | Hayner et al. | |
| 5,630,703 | A * | 5/1997 | Hendley et al. | 416/95 |
| 6,655,913 | B1 * | 12/2003 | Vedantam et al. | 415/214.1 |

* cited by examiner

*Primary Examiner*—Ninh H. Nguyen
(74) *Attorney, Agent, or Firm*—Nixon & Vanderhye P.C.

(57) ABSTRACT

The dovetails of turbine buckets are received in dovetail grooves between circumferentially adjacent wheelposts on a turbine wheel of a gas turbine rotor. The wheel and a spacer are rabbeted one to the other and an axially forwardly extending projection on each bucket dovetail is undercut to space the bucket projection from the outer rim of the spacer eliminating stress on the bucket from the spacer. A cavity is formed between radially outwardly converging wall portions of the spacer and end faces of the wheelposts and bucket dovetails. An annular seal wire conforms and seals between the spacer wall portions and end faces of the wheelposts and bucket dovetails in response to centrifugal forces during turbine operation.

14 Claims, 6 Drawing Sheets

ROTATING SEAL ARRANGEMENT FOR TURBINE BUCKET COOLING CIRCUITS

BACKGROUND OF THE INVENTION

The present invention relates generally to a sealing arrangement for a bucket cooling circuit in a gas turbine engine. More particularly the present invention relates to a conformable seal design that is responsive to centrifugal force to seal between a turbine rotor spacer and the axial end faces of a turbine rotor wheel and bucket dovetails of a heavy duty gas turbine engine in order to minimize leakage of bucket cooling air.

Due to high operating temperatures in gas turbine engines it is common to convectively cool one or more stages of turbine buckets to improve durability. Typically the cooling air is bled from one or more stages of the compressor and is passed to the turbine rotor through various passages that may consist of multiple interfacing parts. The air bled from the compressor is higher in pressure than the air in the turbine and thus each interface poses a potential leak path for the cooling air. One such leak path is the interface between the rotor spacer and the rotor wheelposts and bucket dovetails.

Several methods have been previously employed to seal this type of leak path. In turbines for use as aircraft engines, cover plates (or blade retainers) are installed on the forward and aft sides of the bucket/wheel end faces and have wire seals across the interrupted faces. See, for example, U.S. Pat. Nos. 4,500,098 and 5,622,475. The cover plates serve to seal in cooling air provided the airfoils and also hold the buckets in place axially. Though the seal works well, serviceability of the turbine becomes an issue since replacement of one or more of the buckets requires disassembly of the rotor. Heavy duty land based turbines on the other hand must have the capability to replace buckets in the field. In prior heavy duty turbine designs, there is typically a cylindrical axial protrusion on the spacer rim that has a interference fit (rabbet) with the underside of the wheel rim. A tangential slot is cut into the underside of the wheel rim that penetrates into the dovetail slot. The penetration allows cooling air to pass from the spacer/wheel cavity into the bucket, the rabbet fit between the wheel and spacer rim acting as a seal. A separate hook on the wheel and bucket in combination with a retaining ring holds the bucket axially in place. While this design enables the bucket to be removed in the field, the design results in undesirable stress concentrations in the wheel rim.

Consequently, there has developed a need for a seal assembly which will minimize or eliminate stress concentrations on the wheel, provide an effective seal for cooling air entering the bucket airfoil via the space between the spacer and the wheel and prevent ingestion of hot gas from the gas path into the cooling air flow path.

BRIEF DESCRIPTION OF THE INVENTION

In accordance with a preferred aspect of the present invention, there is provided a seal for sealing between the spacer and axial end faces of the wheelposts and bucket dovetails and which seal relies on a shaped cavity between the spacer and the axial end faces of the wheelposts and bucket dovetails. The seal is responsive to centrifugal force during rotor rotation to seal across not only the joints between the bucket dovetail/wheelpost end faces and the spacer but also between the bucket dovetail/wheelpost interfaces. The shaped cavity is formed by radially outwardly converging angled surfaces on the annular spacer and axially forward end faces of the bucket dovetails and wheelposts. The seal itself is a braided seal which conforms to the shape of the radial outer extremities of the cavity and particularly seals across the bucket dovetail/wheelpost interfaces. The wheelposts have axial projections which overly the rim of the spacer and the interface between the two is by way of an interference fit (rabbet). Additionally, the bucket dovetails have axial projections which overly and are radially spaced from the rim of the spacer such that the spacer rim does not apply load to the buckets due to the rabbet interference.

In a preferred embodiment hereof, there is provided a seal assembly for a turbine comprising a turbine wheel having a plurality of wheelposts circumferentially spaced from one another about a periphery of the wheel defining a plurality of circumferentially spaced generally axially extending grooves, the wheel having a generally annular projection extending axially from a first face thereof interrupted by the grooves; a spacer having an annular arm engaging the interrupted projection; a plurality of turbine buckets each having an airfoil and a base, the bases being disposed in the grooves, each base having an axial projection radially overlying and radially spaced from the arm; an annular surface of the arm and axial faces of the wheelposts and the bucket bases radially inwardly of the projection defining an annular cavity; and a seal disposed in the cavity and in sealing engagement with generally axially opposed wall portions of the arm and wall portions of the axial faces of the wheelposts and bucket bases in response to centrifugal forces on the seal upon rotation of the wheel, buckets and spacer.

In a further preferred embodiment, there is provided a seal assembly for a turbine comprising a turbine wheel having a plurality of wheelposts circumferentially spaced from one another about a periphery of the wheel defining a plurality of circumferentially spaced dovetail shaped grooves therebetween, the wheel having a plurality of projections circumferentially spaced from one another and extending axially from a face thereof, the spaces between the projections being in axial registration with the dovetail shaped grooves; a spacer having an annular arm engaging the projections; a plurality of turbine buckets, each having an airfoil and a dovetail, the bucket dovetails being disposed in the wheel dovetail shaped grooves, each bucket dovetail having a projection extending axially from a first end face thereof and radially overlying and spaced radially outwardly of the arm; an annular surface of the arm and axial faces of the wheelposts and the bucket dovetails radially inwardly of the projections defining an annular cavity; and a seal disposed in the cavity and in sealing engagement with generally axially opposed wall portions of the arm and wall portions of the axial faces of the wheelposts and bucket dovetail end faces in response to centrifugal forces on the seal upon rotation of the wheel, buckets, and spacer.

DETAILED DESCRIPTION OF THE INVENTION

Figure 1:
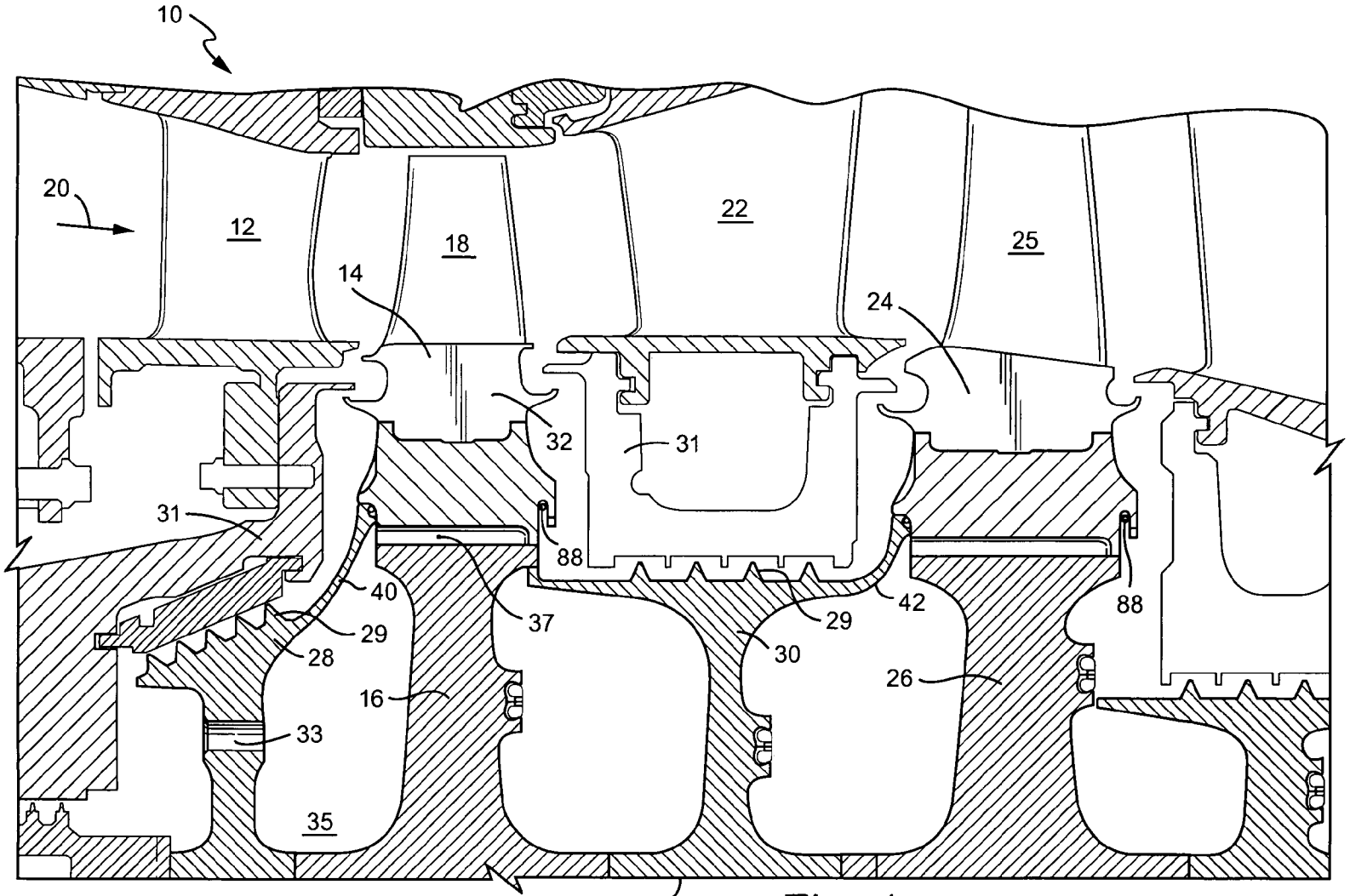
FIG. 1 is a fragmentary schematic illustration of the first and second stage of a heavy duty turbine incorporating a seal assembly according to a preferred aspect of the present invention.

Referring now to the drawing Figures, particularly to FIG. 1, there is illustrated a half section of two stages of a heavy duty turbine generally designated 10. Turbine 10 includes a first stage comprised of a plurality of circumferentially spaced nozzles 12 and buckets 14. The buckets 14 are mounted on a wheel 16 and the nozzles 12 are mounted on stationary components 31. The nozzles 12 and airfoils 18 of buckets 14 lie in the hot gas path of the turbine indicated by the arrow 20. A second stage of the turbine includes a plurality of circumferentially spaced nozzles 22 and buckets 24. The buckets 24 are mounted on a wheel 26 and the nozzles 22 are mounted on stationary components 31. The nozzles 22 and airfoils 25 of buckets 24 lie in the hot gas path of the turbine indicated by the arrow 20. The stage one wheel 16 and stage two wheel 26 are joined together by spacers 28 and 30 to form part of the turbine rotor 11. The rotor 11 rotates with respect to the stationary casing components 31. First and second stage spacers 28 and 30, respectively, have seals 29, preferably labyrinth type seals for sealing with the stationary components 31 of the turbine casing.

As best illustrated in FIGS. 1–4, the buckets also include a shank 32 and a base, e.g., a dovetail 34. The rim of each wheel also includes a plurality of circumferentially spaced wheelposts 36 (FIG. 4) defining a complementary groove, e.g., a dovetail 38, between circumferentially adjacent wheelposts 36 for receiving the dovetail 34 of the bucket. It will be appreciated that the buckets are of the type generally known as axial entry buckets although the buckets may be installed at angles to the axis, e.g., 0–10° or even more, and still be characterized as generally axial entry buckets.

Referring back to FIG. 1, it will be appreciated that compressor discharge cooling air is supplied to the first stage buckets and compressor interstage cooling air is supplied to the second stage buckets. The compressor discharge air flows through apertures 33 in the first stage spacer 28, into a plenum 35 between spacer 28 and wheel 16 and into a passage 37 (FIG. 1) between the base of each bucket dovetail 34 and the base of the corresponding wheel dovetail 38 for flow generally radially outwardly through one or more passages not shown in the bucket for cooling the bucket airfoil. Similarly, compressor interstage bleed air is provided to cool the second stage bucket airfoils and is provided through passages (not shown) into a plenum between the second stage spacer 30 and wheel 26 and into a passage between the base of each bucket dovetail and the base of the associated dovetail groove on wheel 26 for flow in a general radial outward direction to and through the airfoils 25 for cooling purposes.

Figure 2:
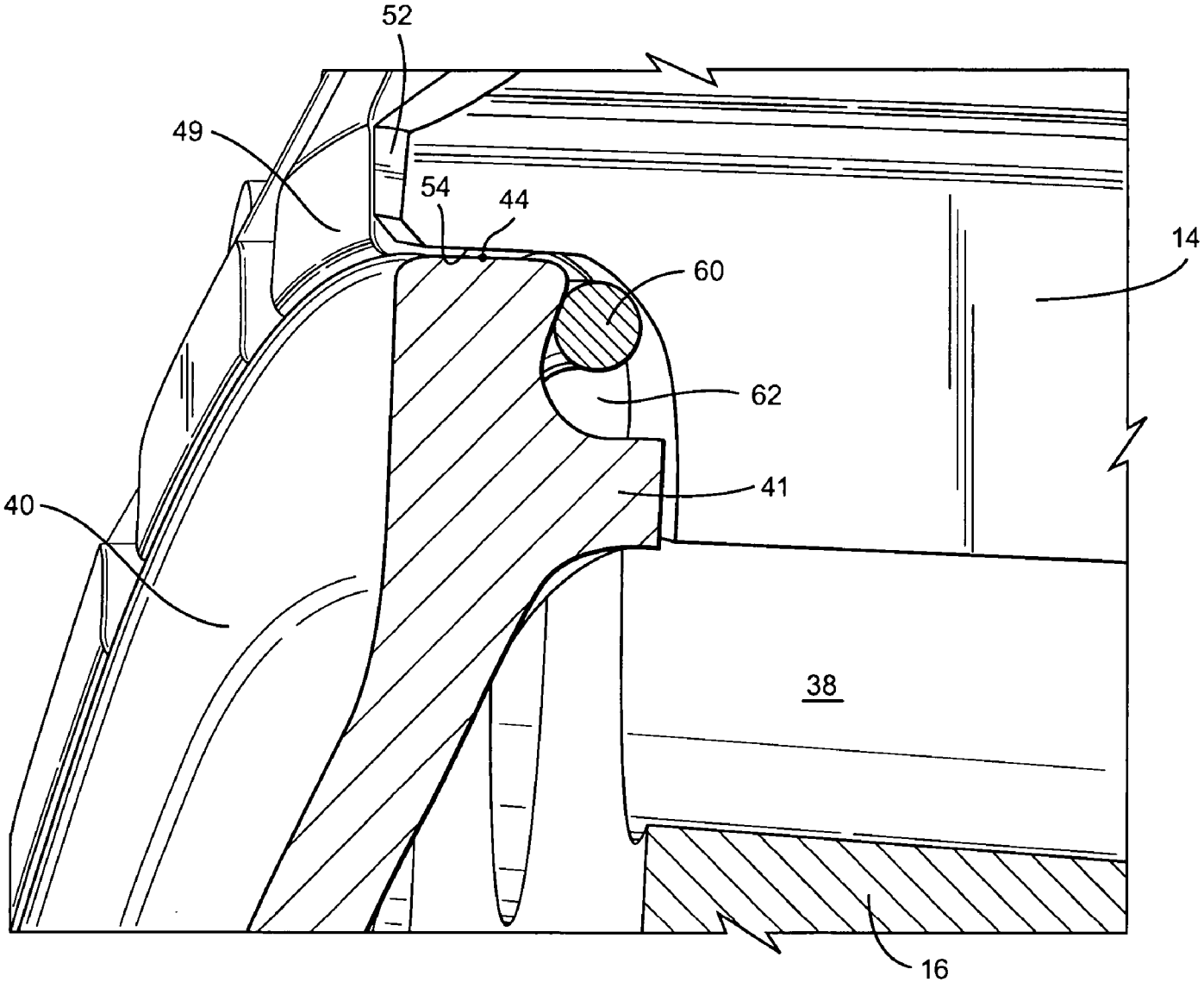
FIG. 2 is a fragmentary perspective view of the spacer arm, wheelposts, and bucket dovetails illustrating the seal and seal cavity.
Figure 3:
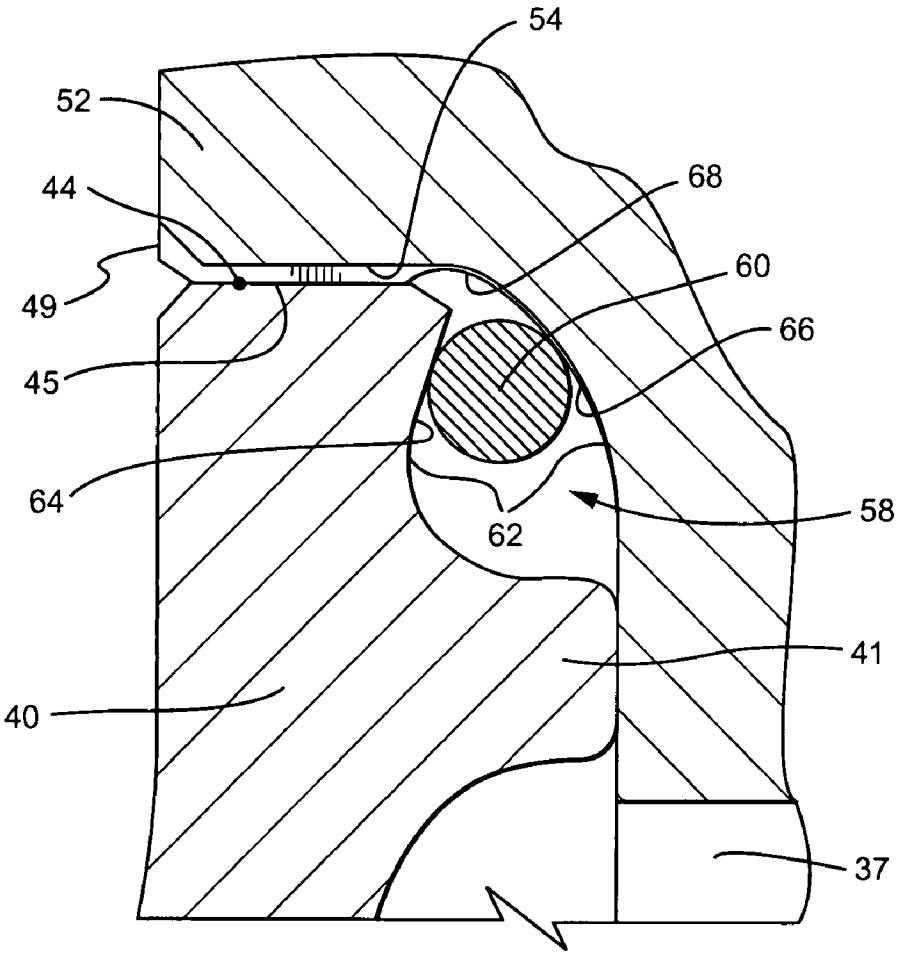
FIG. 3 is an enlarged fragmentary cross-sectional view illustrating the seal assembly between the spacer, wheelposts and bucket dovetails.
Figure 4:
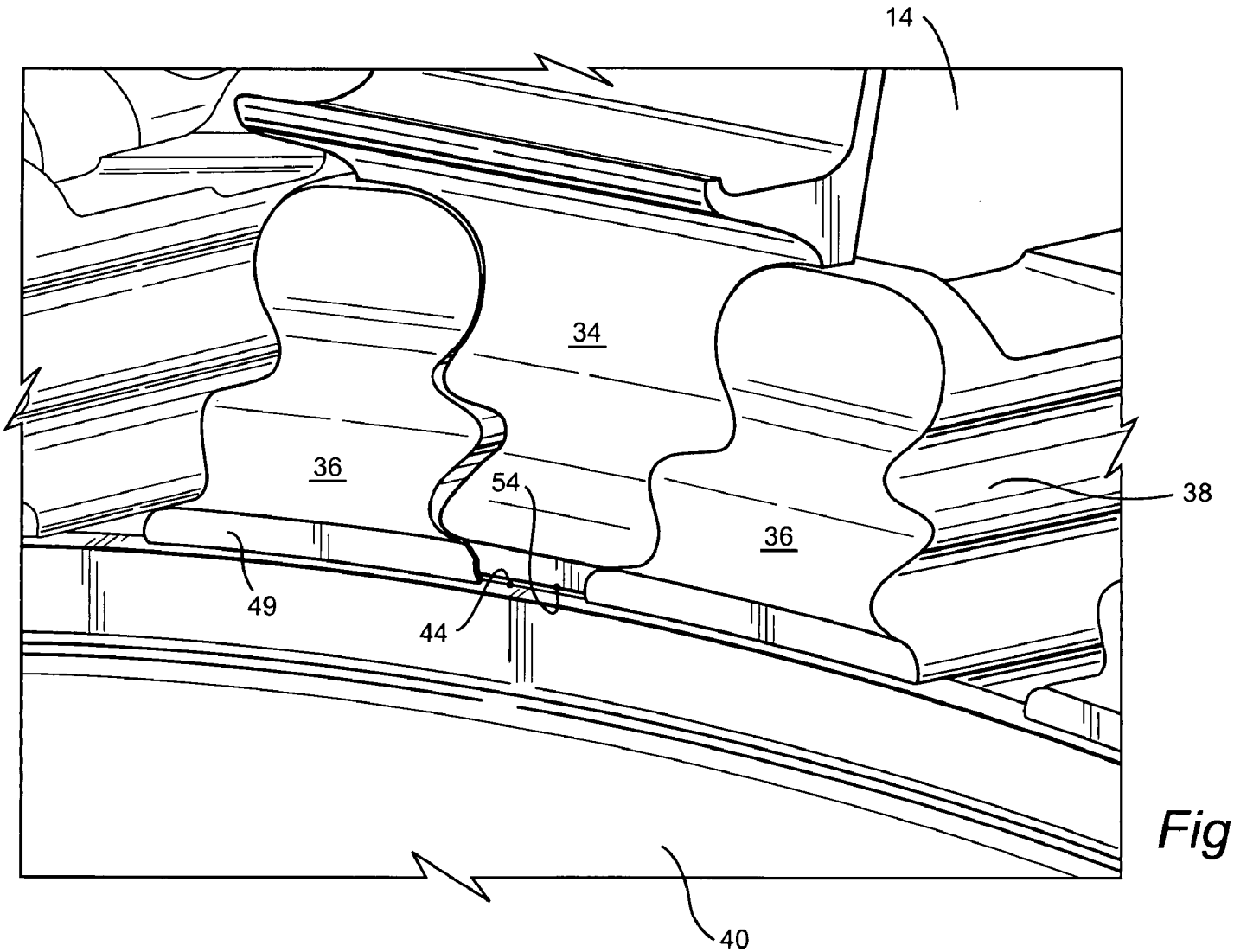
FIG. 4 is a perspective view illustrating the dovetail shaped grooves between the wheelposts and a complementary bucket dovetail in a groove of the wheel.

Generally, the spacers 28 and 30 are secured to the respective wheels 16 and 26 by a rabbeted joint. Particularly, the spacers 28 and 30 are annular in configuration and have arms 40 and 42, respectively (FIG. 1), each of which is an annulus secured to the axial face of the associated wheel. The spacer arms 40 and 42 each have an annular, axially aft projection 41 for engaging the forward end face at the corresponding wheel. Referring to FIGS. 2 and 3, the rabbeted joint between the spacer arm 40 and the first stage wheel 16 is illustrated, it being appreciated that the spacer arm 42 and wheel 26 are secured to one another similarly. In FIG. 3, the spacer arm 40 terminates in a radially outwardly facing generally axially extending annular surface 44 which engages a radially inwardly facing axially projecting surface 45 on the wheel 16. The surface 45 forms part of an axially forwardly projecting interrupted rabbet or projection 49 about the forward axial face of wheel 16, the interruptions being formed by the adjacent dovetail grooves 38 between circumferentially adjacent wheelposts 36. That is, the interrupted rabbet 49 on the wheel 16 lies at a radial distance which also intersects each of the dovetail grooves 38 on the wheel. The wheels and spacers are rabbeted one to another upon assembly such that the spacer arm 40 is preloaded and pressed radially outwardly into the wheelposts 36. This maintains the arms and wheels secured tightly to one another during transient start-ups and shut-downs of the engine.

As best illustrated in FIG. 3, the dovetail base 34 of each bucket has an axial forward projection 52 which overlies and is spaced radially outwardly from the outer annular surface 44 of the spacer arm. More particularly, each projection 52 is undercut such that the axially extending surface 54 thereof is spaced radially outwardly of the outer surface 44 of the spacer arm 40. This prevents the spacer 28 from loading the buckets due to the rabbet fit between the spacer and wheel.

It will be appreciated from a review of FIG. 3 that the wheelposts 36 have forwardly facing end faces which lie generally flush with the forwardly facing end faces of the dovetails of the buckets. A seal assembly, generally designated 58, is provided between the spacer arm 40 adjacent its periphery and the axial end faces of the bucket dovetails 34 and the wheelposts 36. Particularly, seal assembly 58 includes an annular wire seal 60 disposed in a shaped cavity 62. The cavity 62 is shaped by wall portions 64 of the aft face of the spacer arm 40 and wall portions 66 and 68, of the forward axial end faces of the bucket dovetails and wheelposts, respectively. The aft face of the spacer arm 40 defining cavity 62 includes wall portions 64 which are inclined radially outwardly and in an axially aft direction. The end face wall portions 66 and 68 of the bucket dovetails and wheelposts are arcuate and inclined radially outwardly in an axially forward direction. Thus, the cavity has wall portions which converge radially outwardly. The wire seal 60 is disposed between those wall portions 64 on the spacer arm 40 and wall portions 66 and 68 of the end faces of the bucket dovetails and wheelposts.

Figure 7:
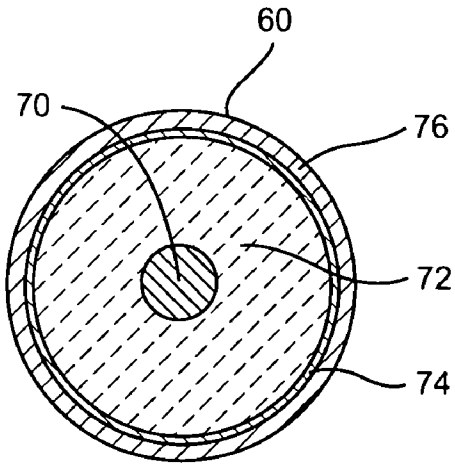
FIG. 7 is an enlarged cross-sectional view illustrating the components of the seal.

The seal 60 is preferably a braided wire seal conformable to the shaped cavity 62 in response to centrifugal forces acting on the seal during turbine rotor rotation. The centrifugal forces act on the wire seal to conform it into any gap that may form between the end faces of the bucket dovetail 34 and wheelposts 36 due to very small bucket movements in an axial or radial direction relative to the wheelposts. The seal 60 comprises a multi-layer seal having an internal, preferably Inconel inner core 70 (FIG. 7), preferably braided wire, an amorphous silica outer core 72, a layer of inconel foil braid 74 and a preferred Inconel outer wire braid 76. The Inconel inner core 70 provides durability while the silica outer core allows for compressibility of the seal. The foil braid 74 improves the sealing capacity of the wire rendering the outer braid 76 the primary path available through which air may flow. The outer braid, however, provides a very tortuous leak path which minimizes any leakage of air around the seal. The outer braid 76 also provides durability and survivability of the seal in harsh engine environments. Alternatively a second configuration of the wire seal 60 consists of an all Inconel wire braid without the amorphous silica core or foil braid previously discussed.

It will be appreciated that upon operation of the turbine, the seal 60 distorts and generally conforms to the shape of the cavity 62 adjacent radial outward extremities thereof by centrifugal loading against the sealing wall portions of both the spacer and the end faces of the bucket dovetails and wheelposts. The wire seal 60 thus seals the bucket cooling air from egress into the hot gas path 20 and prevents ingestion of hot gas into the cooling air flow path.

It will be appreciated that the foregoing seal arrangement enables removal of one or more of the buckets in an axial aft direction during service outages. Particularly, and referring to drawing FIGS. 6A–6D, the buckets may be removed from the corresponding wheel upon their displacement in an aft direction and also installed onto the wheel in the opposite forward direction. The buckets are maintained during turbine operation against axial aft movement by an annular retaining ring. As illustrated in FIGS. 6A–6D, each of the aft faces of the wheelposts have a radially inwardly directed hook 80 (FIGS. 6B and 6C) defining a slot 82. Similarly, each of the aft faces of the bucket dovetails has a radially inwardly directed hook 84 defining a corresponding slot 86 at like radial and axial locations as the hooks 80 and slots 82 of the wheelposts. When the buckets are in final position on the wheels, the slots 82 and 86 defined by the wheelposts and bucket dovetail hooks 80 and 84, respectively, are aligned axially, enabling installation of an annular bucket retaining ring 88. Thus, to remove the buckets for service or to replace the seal 60, the bucket retaining ring 88 is displaced inwardly and removed from the captive slots 82 and 86. This frees the buckets for displacement in an axially aft direction to remove the buckets from the associated wheel.

Figure 5:
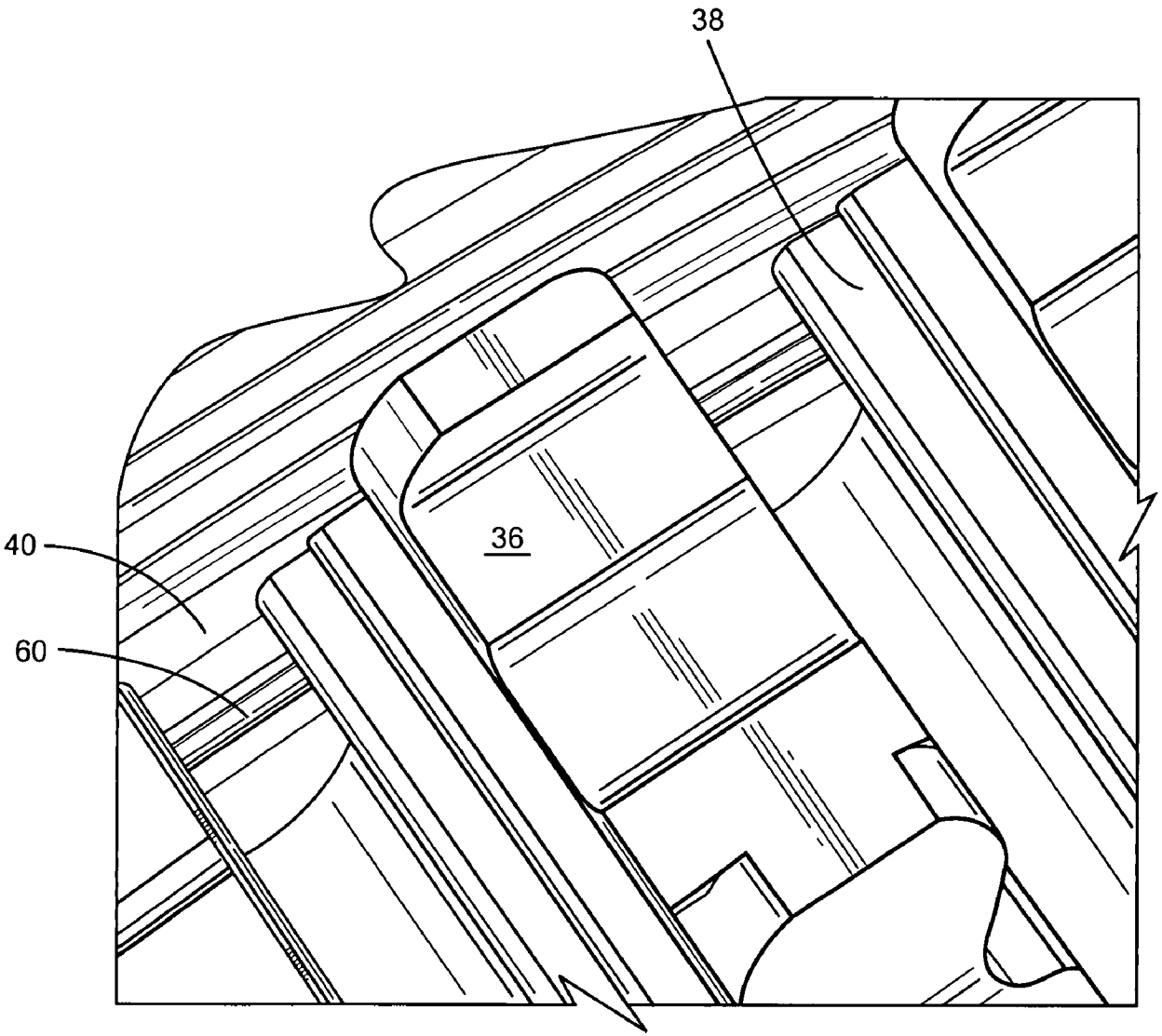
FIG. 5 is a fragmentary perspective view of the periphery of the wheel looking generally radially inwardly at a wheelpost flanked by the dovetail grooves for receiving the bucket dovetails and illustrating the position of the wire seal.
Figure 6A:
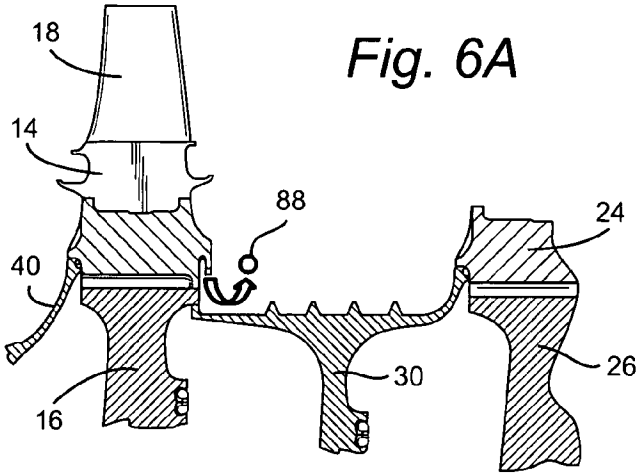
FIGS. 6A–6D are schematic illustrations of a method of replacing the buckets and wire seal without disassembly of the rotor.
Figure 6B:
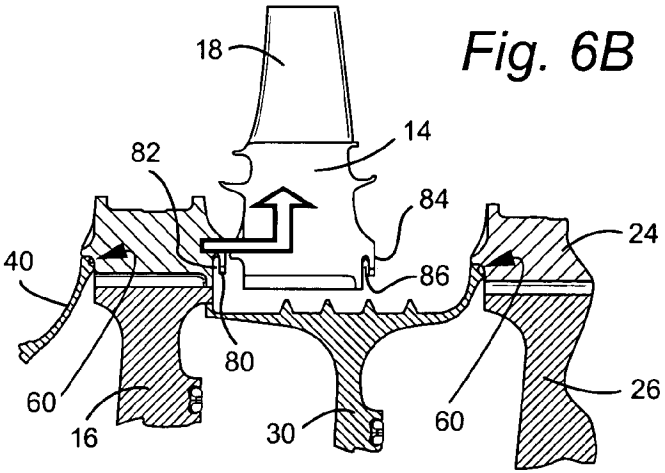
Figure 6C:
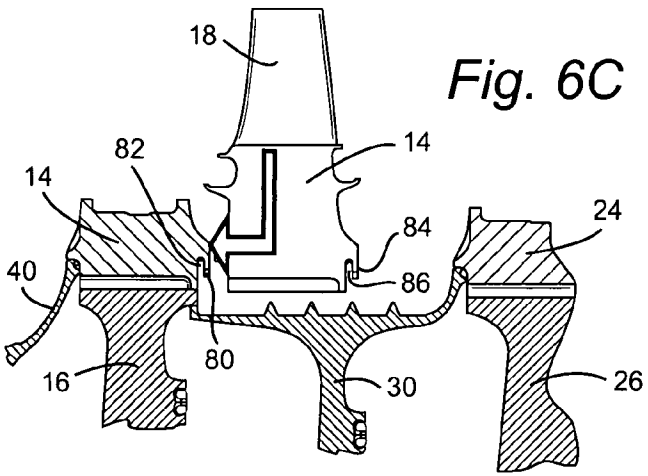
Figure 6D:
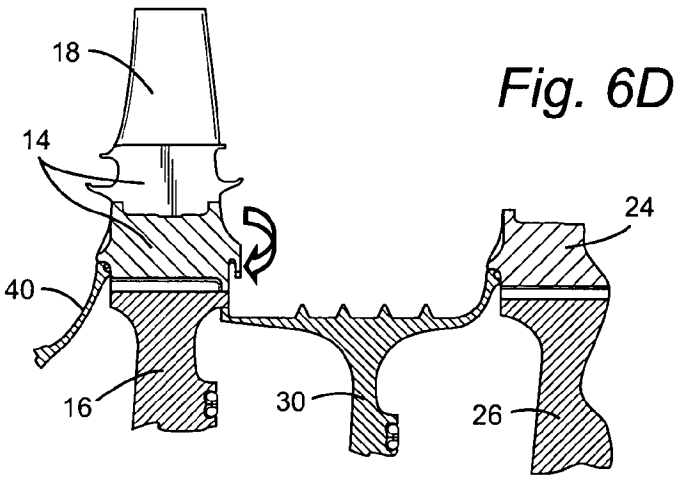

Upon removal of the buckets, access to the wire seal 60 is obtained through the vacated dovetail grooves 38 of the wheel (FIG. 5), enabling removal and replacement of the seal 60 as necessary or desirable. The seal 60 is flexible and enables the seal to be fed circumferentially into the exposed seal cavity. The buckets can then be reinstalled or new buckets can be installed by displacing the dovetails of the buckets along the dovetail grooves to axially align the bucket retaining slots 82 and 86. The bucket retaining ring 88 is then installed to retain the buckets against axial movement relative to the corresponding wheel.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A seal assembly for a turbine comprising:

a turbine wheel having a plurality of wheelposts circumferentially spaced from one another about a periphery of said wheel defining a plurality of circumferentially spaced generally axially extending grooves, said wheel having a generally annular projection extending axially from a first face thereof interrupted by the grooves;

a spacer having an annular arm engaging said interrupted projection;

a plurality of turbine buckets each having an airfoil and a base, said bases being disposed in said grooves, each said base having an axial projection radially overlying and radially spaced from said arm;

an annular surface of said arm and axial faces of said wheelposts and said bucket bases radially inwardly of said projection defining an annular cavity; and a seal disposed in said cavity and in sealing engagement with generally axially opposed wall portions of said arm and wall portions of said axial faces of said wheelposts and bucket bases in response to centrifugal forces on said seal upon rotation of the wheel, buckets and spacer.

2. An assembly according to claim 1 wherein the wall portions of said spacer arm extend radially outwardly and axially toward said wheel, said wall portions of said wheelposts and said bucket bases extending radially outwardly and axially away from said wheel.

3. An assembly according to claim 1 wherein said seal is formed of a material conformable to the shape of said cavity when in sealing engagement with the wall portions of said arm and wall portions of the axial faces of said bucket bases and the faces of said wheelposts.

4. An assembly according to claim 1 wherein said seal is formed of an inner metal core, a silica overbraid, a layer of metal foil and a metal outer braid.

5. An assembly according to claim 1 wherein each said bucket base has a dovetail configuration and each said groove has a generally complementary dovetail configuration.

6. An assembly according to claim 1 wherein the wall portions of said spacer arm extend radially outwardly and axially toward said wheel, said wall portions of said wheelposts and said bucket bases extending radially outwardly and axially away from said wheel; and wherein said seal is formed of a material conformable to the shape of said cavity when in sealing engagement with the wall portions of said arm and wall portions of the axial faces of said bucket bases and the faces of said wheelposts.

7. An assembly according to claim 6 wherein said seal is formed of an inner metal core, a silica overbraid, a layer of metal foil and a metal outer braid; said bucket base having a dovetail configuration and each said groove having a generally complementary dovetail configuration.

8. An assembly according to claim 1 wherein said wheelposts have hooks defining generally radially extending slots along a second axial face of said wheel opposite said first face, said bases having hooks defining generally radially extending slots along end faces thereof in axial registration with the wheelpost slots and an annular retaining ring disposed in said registering hooks to releasably retain the buckets in said grooves against generally axial displacement of the buckets in an aft direction relative to said wheel.

9. A seal assembly for a turbine comprising:

a turbine wheel having a plurality of wheelposts circumferentially spaced from one another about a periphery of said wheel defining a plurality of circumferentially spaced dovetail shaped grooves therebetween, said wheel having a plurality of projections circumferentially spaced from one another and extending axially from a face thereof, the spaces between said projections being in axial registration with said dovetail shaped grooves;

a spacer having an annular arm engaging said projections;

a plurality of turbine buckets, each having an airfoil and a dovetail, said bucket dovetails being disposed in said wheel dovetail shaped grooves, each said bucket dovetail having a projection extending axially from a first end face thereof and radially overlying and spaced radially outwardly of said arm;

an annular surface of said arm and axial faces of said wheelposts and said bucket dovetails radially inwardly of said projections defining an annular cavity; and a seal disposed in said cavity and in sealing engagement with generally axially opposed wall portions of said arm and wall portions of said axial faces of said wheelposts and bucket dovetail end faces in response to centrifugal forces on said seal upon rotation of the wheel, buckets, and spacer.

10. An assembly according to claim 9 wherein the wall portions of said spacer arm extend radially outwardly and axially toward said wheel, said wall portions of said wheelposts and said bucket dovetails extending radially outwardly and axially away from said wheel.

11. An assembly according to claim 9 wherein said seal is formed of a material conformable to the shape of said cavity when in sealing engagement with the wall portions of said arm and wall portions of the axial end faces of said bucket dovetails and the faces of said wheelposts.

12. An assembly according to claim 9 wherein said seal is formed of an inner metal core, a silica overbraid, a layer of metal foil and a metal outer braid.

13. An assembly according to claim 9 wherein the wall portions of said spacer arm extend radially outwardly and axially toward said wheel, said wall portions of said wheelposts and said bucket bases extending radially outwardly and axially away from said wheel; said seal being formed of a material conformable to the shape of said cavity when in sealing engagement with the wall portions of said arm and wall portions of the axial faces of said bucket bases and the faces of said wheelposts.

14. An assembly according to claim 9 wherein said wheelposts have hooks defining generally radially extending slots along a second axial face of said wheel opposite said first face, said dovetails having hooks defining generally radially extending slots along end faces thereof in axial registration with the wheelpost slots and an annular retaining ring disposed in said registering hooks to releasably retain the buckets in said grooves against generally axial displacement of the buckets in an aft direction relative to said wheel.

* * * * *